US006337671B1

(12) United States Patent
Lee

(10) Patent No.: US 6,337,671 B1
(45) Date of Patent: Jan. 8, 2002

(54) POWER ANTENNA APPARATUS AND APPLICATION THEREOF TO WIRELESS COMMUNICATION SYSTEM

(76) Inventor: Han Sang Lee, 839, Kojeol-Ri, Cheokryang-Myeon, Hadong-Kun, Kyeongsangnam-Do, 135-080 (KR)

( * ) Notice: Subject to any disclaimer, the term of this patent is extended or adjusted under 35 U.S.C. 154(b) by 0 days.

(21) Appl. No.: 09/241,420

(22) Filed: Feb. 2, 1999

(30) Foreign Application Priority Data

Feb. 12, 1998 (KR) ..... 98-4228
Sep. 24, 1998 (KR) ..... 98-39781

(51) Int. Cl.[7] ..... H01Q 1/10
(52) U.S. Cl. ..... 343/901; 343/702; 455/89
(58) Field of Search ..... 343/901, 702, 343/903, 823, 713; 455/89, 90, 97, 269; H01Q 1/10, 1/24

(56) References Cited

U.S. PATENT DOCUMENTS 2,522,222 A * 9/1950 Haller ..... 343/872
3,803,627 A * 4/1974 Schuscheng ..... 343/903
5,166,695 A * 11/1992 Chan et al. ..... 343/702
5,497,506 A * 3/1996 Takeyasu ..... 455/89
5,642,123 A * 6/1997 Shinkawa ..... 343/903
5,689,821 A 11/1997 Shimazaki ..... 455/89
5,859,622 A * 1/1999 Phillips ..... 343/903
6,172,645 B1 * 1/2001 Hollander et al. ..... 343/702
6,191,742 B1 * 2/2001 Ha et al. ..... 343/702
6,218,993 B1 * 4/2001 Chao et al. ..... 343/702
6,239,754 B1 * 5/2001 Kim ..... 343/702

FOREIGN PATENT DOCUMENTS

GB 2 289 990 A 12/1995
JP 05-336022 12/1973

* cited by examiner

*Primary Examiner*—Don Wong
*Assistant Examiner*—Trinh Vo Dinh
(74) *Attorney, Agent, or Firm*—Nixon Peabody LLP; Thomas W. Cole

(57) ABSTRACT

Disclosed is a power antenna apparatus for automatically extracting/retracting an antenna. A motor is controlled by a control circuit to generate a rotational force. An antenna housing has a guide slot extending longitudinally on an inner surface thereof. A rotary member is installed in the antenna housing and is rotated by the motor. A coil spring is rotatably accommodated in the antenna housing and one end thereof is fixed to the rotary member. An antenna conveying member is received together with the antenna within the coil spring as being fixedly coupled with the antenna by a lower end of the antenna. The antenna conveying member has protrusions which are loosely inserted into the guide slot of the antenna housing and conveys the antenna along with the guide slot to extract or retract the antenna by means of a rotation of the coil spring. Other embodiments are disclosed for flexible installation of the apparatus. Application of the apparatus to a wireless telephone is also disclosed.

14 Claims, 14 Drawing Sheets

POWER ANTENNA APPARATUS AND APPLICATION THEREOF TO WIRELESS COMMUNICATION SYSTEM

BACKGROUND OF THE INVENTION

1. Field of the Invention

The present invention relates to a power antenna apparatus, and more particularly, relates to a power antenna apparatus which, in a mobile communication apparatus such as a cellular phone and the like, enables an antenna to be automatically drawn out or led in.

2. Description of the Prior Art

Generally, a power antenna apparatus pulls an antenna into an antenna housing when not in use, draws out the antenna from the antenna housing by a rotational force of an electric motor when in use, and leads to pull the antenna again into the antenna housing when the use of the antenna is completed.

Recent researches into and developments on the technology of power antennas have been applied to antennas for mobile communication apparatuses such as mobile telephones, cellular phones and a personal communication system.

There has been a technology in which the drawing-out or the lead-in of an antenna is controlled by installing a rod at a lower end portion of the antenna and by transporting a screw rod with a turning force of an electric motor. Here, because the screw rod needs to be transported, a length of an antenna housing is required to be twice as long as a drawing-out length of the antenna. Also, because an external force which has an influence on the antenna is delivered to a transport mechanism as it stands, the external force acts on the transport mechanism or on the electric motor and thereby they are apt to be damaged or broken down.

In U.S. Pat. No. 5,497,506, disclosed is a technology in which the drawing-out or the lead-in of an antenna is activated by installing a transport nut at a lower end portion of the antenna and by transporting the transport nut under the guidance of a spiral of a screw rod with a turning force of the screw rod which is rotated by an electric motor. In this patent, because the screw rod is received into an inner side of a pipe-shaped antenna, a length of an antenna housing is required to be the same as a drawing-out length of the antenna. Similarly, because an external force which has an influence on the antenna is delivered to a transport mechanism as it stands, the external force acts on the transport mechanism or on the electric motor and thereby they are apt to be damaged or broken down.

SUMMARY OF THE INVENTION

Therefore, it is an object of the present invention to provide a power antenna apparatus in which, while an antenna transport assembly transports under guidance of a spiral of a rotating coil spring, a drawing-out or a lead-in of an antenna is controlled, an external force acted on the antenna is absorbed at the same time, and thereby the durability of a driving apparatus can be improved.

It is another object of the present invention to provide a power antenna apparatus in which an external force is absorbed by a coil spring and thereby a motor control circuit is configured by a simplified on/off control.

It is a further object of the present invention to provide a wireless communication apparatus which adopts the power antenna.

It is a fourth object of the present invention of the present invention to provide a power antenna apparatus which a motor as a power source for driving the antenna can allow to installed in a random place so that its application field can be extended to a mobile telephone with a narrow permissible space for installation.

According to the present invention, there is provided a power antenna apparatus for extracting/retracting an antenna from/into an antenna housing, comprising; a driving means for generating a rotational force; and a transporting means, accommodated in the antenna housing, for carrying the antenna in a longitudinal direction of the antenna as being conveyed along a spiral of a coil spring which is rotated by the driving means.

As another preferable aspect of the present invention, there is provided a power antenna apparatus for automatically extracting/retracting an antenna of a wireless communication device, comprising; a motor for generating a rotational force by using an electric energy; a motor control means for controlling operation of the motor by providing a driving power in response to a communication-start signal and a communication-end signal of the wireless communication device; an antenna housing having a guide slot extending longitudinally on an inner surface of the antenna housing; a rotary member installed at one end of the antenna housing and rotated by the motor; a coil spring rotatably accommodated in the antenna housing, one end of the coil spring being fixed to the rotary member; and an antenna conveying member received together with the antenna within the coil spring as being fixedly coupled with the antenna by a lower end of the antenna, having protrusions which are loosely inserted into the guide slot of the antenna housing, for conveying the antenna along with the guide slot to extract or retract the antenna by means of rotation of the coil spring.

As a further preferable aspect of the present invention, there is provided a power antenna apparatus for automatically extracting/retracting an antenna in a longitudinal direction of the antenna, comprising; a motor, having a driving shaft, for generating a rotational force by using an electric energy; a deceleration gear assembly engaged with the driving shaft of the motor; an antenna housing having a guide slot extending longitudinally on an inner surface of the antenna housing; a rotary member rotatably accommodated in the antenna housing and rotated by a transferred rotational force originated from the motor; a force transferring means, both ends thereof being fixed to the deceleration gear assembly and the rotary member, for transferring the rotational force of the motor to the rotary member; a coil spring rotatably accommodated in the antenna housing, one end of the coil spring being fixed to the rotary member, rotated together with the rotary member; and an antenna carrying member received together with the antenna in the coil spring as being fixedly coupled with the antenna by a lower end of the antenna, having protrusions which are loosely with the guide slot of the antenna housing, for carrying the antenna along with the guide slot to extract or retract the antenna by means of rotation of the coil spring.

As an preferable aspect of an application of the power antenna apparatus to a wireless communication apparatus, for example, a cellular phone and the like, there is provided a wireless communication apparatus having an antenna which is moved in a length direction thereof so as to be extracted from or retracted into a case of the wireless communication apparatus, the wireless communication apparatus comprising; a means for inputting/outputting an information; a transmitting/receiving circuit means for processing an input/output signal from the inputting/outputting means, for modulating the processed input/output signal into a radio signal and then transmitting the modulated radio signal through the antenna, or for demodulating a signal received through the antenna, processing the demodulated signal and providing the processed signal to the inputting/outputting means; a driving means for generating a rotational force in response to an operation of the transmitting/receiving circuit means; and a means for carrying the antenna, tightly coupled with the antenna, the carrying means moving in a longitudinal direction of the antenna along a spiral of a coil spring when the coil spring is rotated by the rotational force of the driving means, thereby carrying the antenna in the longitudinal direction.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

Hereinafter, a preferred embodiment of the present invention will be explained in detail with reference to the accompanying drawings.

Figure 1:
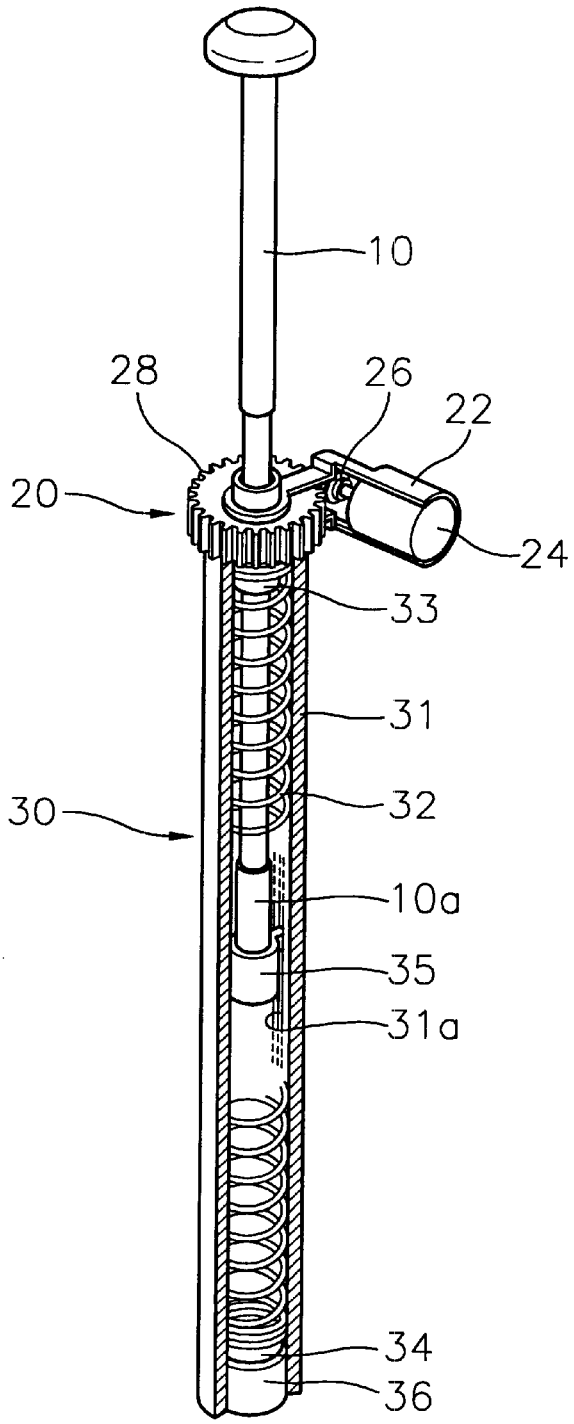
FIG. 1 is a perspective view for showing a structure of a power antenna apparatus according to an embodiment of the present invention.

FIG. 1 is a perspective view showing a preferred embodiment of a power antenna apparatus according to the present invention. As shown in FIG. 1; the power antenna apparatus comprises an antenna 10, a driving unit 20 and a transport unit 30.

Figure 2A:
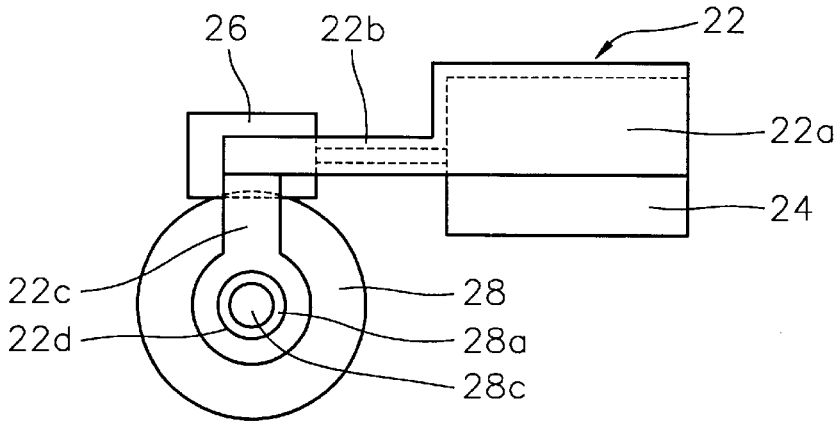
FIGS. 2A to 2C are views for showing structures of a plane, front and side of a rotation driving unit, respectively.
Figure 2B:
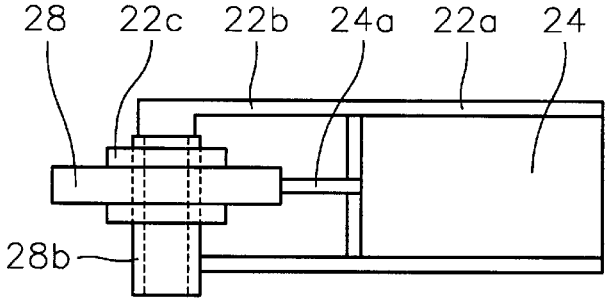
Figure 2C:
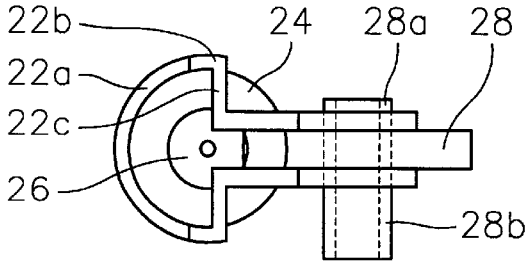

FIG. 2*a* is a plan view showing the driving unit, FIG. 2*b* is a front view thereof and FIG. 2*c* is a side view seen from the left thereof. As shown in FIG. 2, driving unit 20 comprises a housing 22, a motor 24, a driving gear 26 and a following gear 28.

Housing 22 comprises a motor supporting member 22*a* which has a cylindrical shape and of which one side is opened, and a couple of L-shaped supports which consist of extension portions extending parallel with a driving shaft 24*a* of motor 24 from both edges of motor supporting member 22*a* facing with each other and crank-shaped bent portions 22*c* bent from edges of extension portions 22*b*. At both edges of bent portions 22*c* facing with each other, shaft holes 22*d* are formed so as to insert bosses 28*a* and 28*b* of following gear 28 therethrough. Driving gear 26 is a worm coupled to driving shaft 24*a* of motor 24, and following gear 28 is a worm wheel positioned between a pair of bent portions 22*c*, a shaft of following gear 28 being inserted into a pair of shaft holes 22*d*. Worm and worm wheel 26 and 28 are engaged with each other. Shaft holes 22*d* have an inner diameter so that antenna 10 can pass therethrough. Lower boss 28*b* of worm wheel 28 is longer than an upper boss 28*a*. The motor is a coreless type direct current (DC) motor whose diameter is, for example, about 4–6 mm.

Transport unit 30 comprises an antenna housing 31, for example, being cylinder-shaped, a coil spring 32, an upper supporting member 33, a lower supporting member 34, a carrying member 35 and a housing stopple 36.

Antenna housing 31 is formed at an inner wall thereof with guide slots 31*a* extending longitudinally thereof and receives coil spring 32. Coil spring 32 is rotatably supported by upper and lower supporting members 33 and 34. Upper supporting member 33 is rotatably assembled at a latching groove 33*a* thereof to a shoulder 31*b* formed around an upper entrance of antenna housing 31. An upper edge of coil spring 32 is press-fitted to an outer wall of boss 33*b*. Preferably, an inner wall of upper supporting member 33 and an outer wall of lower boss 28*b* of following gear 28 are tightly coupled so as to ensure a stable transmission of the rotational force originated from motor 24. Housing stopple 36 is press-fitted into a lower entrance of antenna housing 31.

Carrying member 35, having a cylinder shape, is placed inside of coil spring 32 and is formed with a couple of protrusions 35*a* which are protruded through coil spring 32 and are inserted to guide slots 31*a* formed at the inner wall of antenna housing 31. Preferably, protrusions 35*a* have a rod shape. Antenna 10 is inserted at a lower edge thereof to a hole 35*b* of carrying member 35.

Preferably, transport unit 30 is made of a resilient material so that it can be installed even in a space which is not straight. Even if antenna housing 31 and coil spring 32 are bent slightly, the bent structure cannot affect to a vertical movement of carrying member 35 since a pitch of the coil is much shorter than a whole length of coil spring 32.

Figure 3:
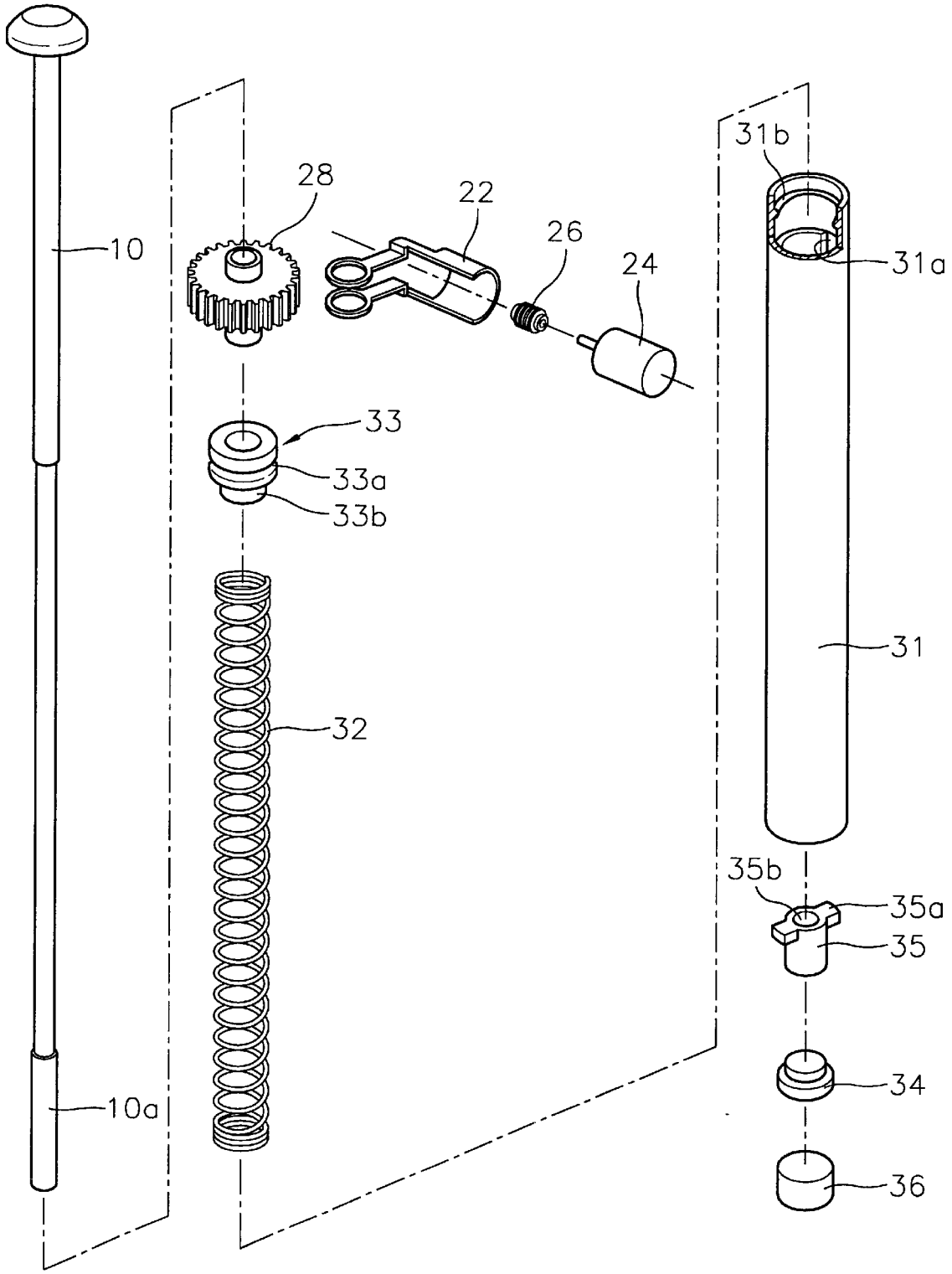
FIG. 3 is a disassembly perspective view for showing a structure of the power antenna apparatus shown in FIG. 1.

Hereinafter, the assembling process of the power antenna apparatus according to the present invention will be described with reference to the accompanying drawings. FIG. 3 is an exploded perspective view showing an embodiment according to the present invention.

At first, carrying member 35 is installed inside coil spring 32. Upper supporting member 33 is press-fitted into an upper edge of coil spring 32 and lower supporting member 34 is assembled to a lower edge of coil spring 32. Housing stopple 36 is press-fitted into the lower entrance of antenna housing 31. Then, the coil spring assembly is inserted to the upper entrance of antenna housing 31. Upper supporting member 33 is press-fitted at latching groove 33*a* thereof to shoulder 31*b* formed on an upper inner wall of antenna housing 31, thereby completing the assembling of the transport unit 30.

Upper supporting member 33 of assembled transport unit 30 is press-fitted into lower boss 28*b* of following gear 28 of driving unit 20, thereby assembling transport unit 30 to driving unit 20.

Antenna 10 is inserted through a shaft hole 28*c* of following gear 28 and is further inserted into the hole formed at carrying member 35 of transport unit 30, thereby completing the assembling thereof.

Figure 4:
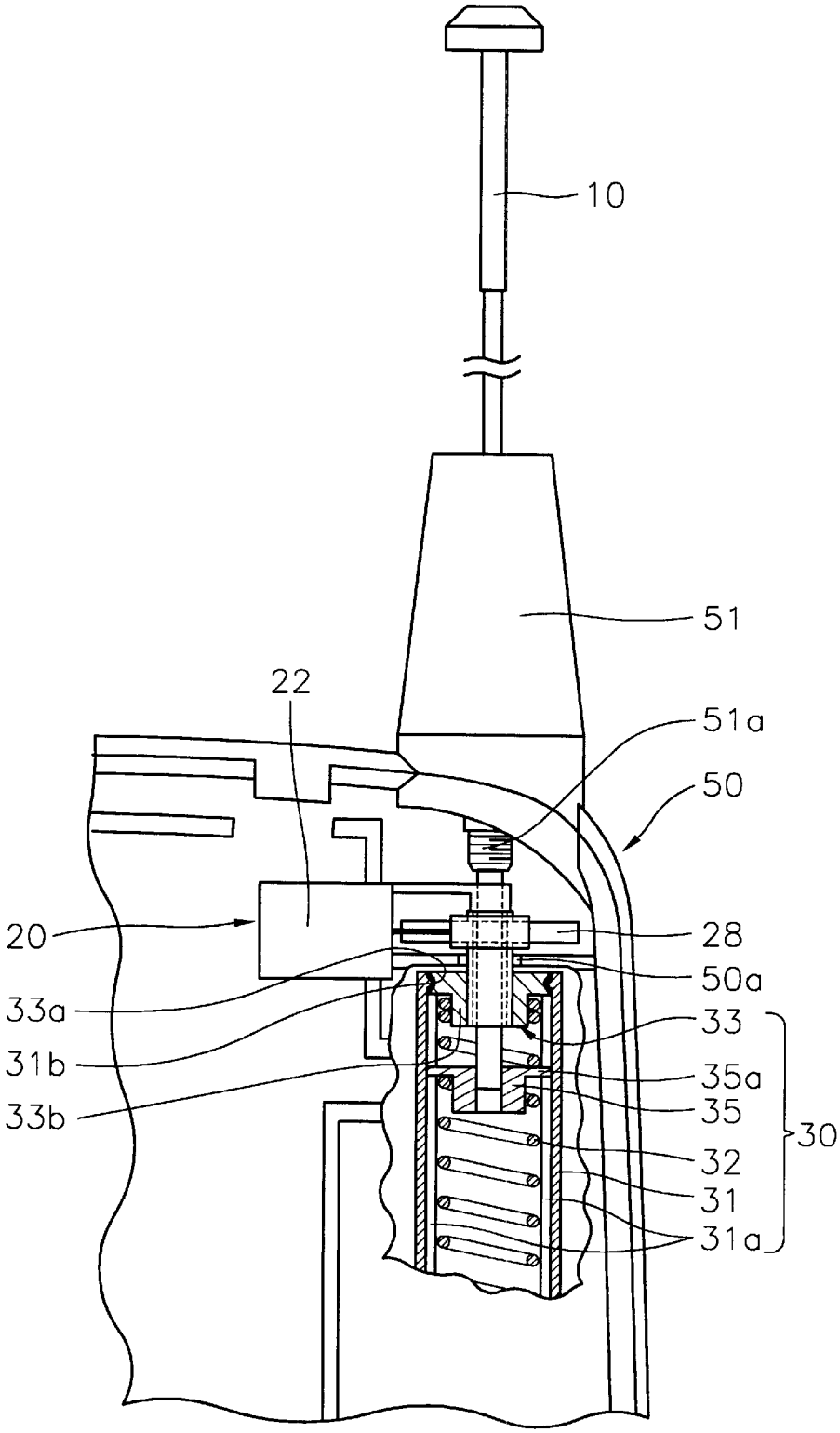
FIG. 4 is a view for showing a portion of a mobile telephone which adopts the power antenna apparatus according to the present invention.

FIG. 4 is a cross-sectional view showing the power antenna apparatus of a wireless communication apparatus such as a cellular phone and the like. Driving unit 20 is installed inside a case 50 of the cellular phone. Lower boss 28*b* of following gear 28 is protruded outside the case by a predetermined distance through an opening 50*a* formed at case 50 so as to be assembled to transport unit 30. Transport unit 30 is installed at a rear portion of the case at which a battery pack (not shown) is assembled. Accordingly, transport unit 30 is installed between the battery pack and a rear wall of case 50 so that transport unit 30 is not exposed to an outside thereof after the battery pack is assembled. As mentioned above, for coupling driving unit 20 with transport unit 30, driving unit 20 is assembled at lower boss 28*b* of following gear 28 thereof to the hole formed at upper supporting member 33. In the state that driving unit 20 and transport unit 30 are assembled with case 50, antenna 10 is inserted through a bore (not shown) formed at a center of a coil antenna 51, then being further inserted through shaft hole 28*c* of following gear 28, being finally inserted into the hole formed at carrying member 35 previously inserted into antenna housing 31. Coil antenna 51 is screwed to an antenna connection section (not shown) of a transmitter-receiver circuit.

Therefore, driving unit 20 is assembled into the case at the same time when inside elements of the cellular phone are assembled into the case. Transport unit 30 and antenna 10 are easily assembled from the outside thereof after the casing process is finished. The above described structure can compatibly be installed in an installing space of a conventional cellular phone. When antenna 10 is fully extracted, a metal part 10*a* of a lower portion of antenna 10 makes contact with a metal part 51*a* of a lower portion of coil antenna 51 so as to electrically communicate with the transmitter-receiver circuit.

Figure 5:
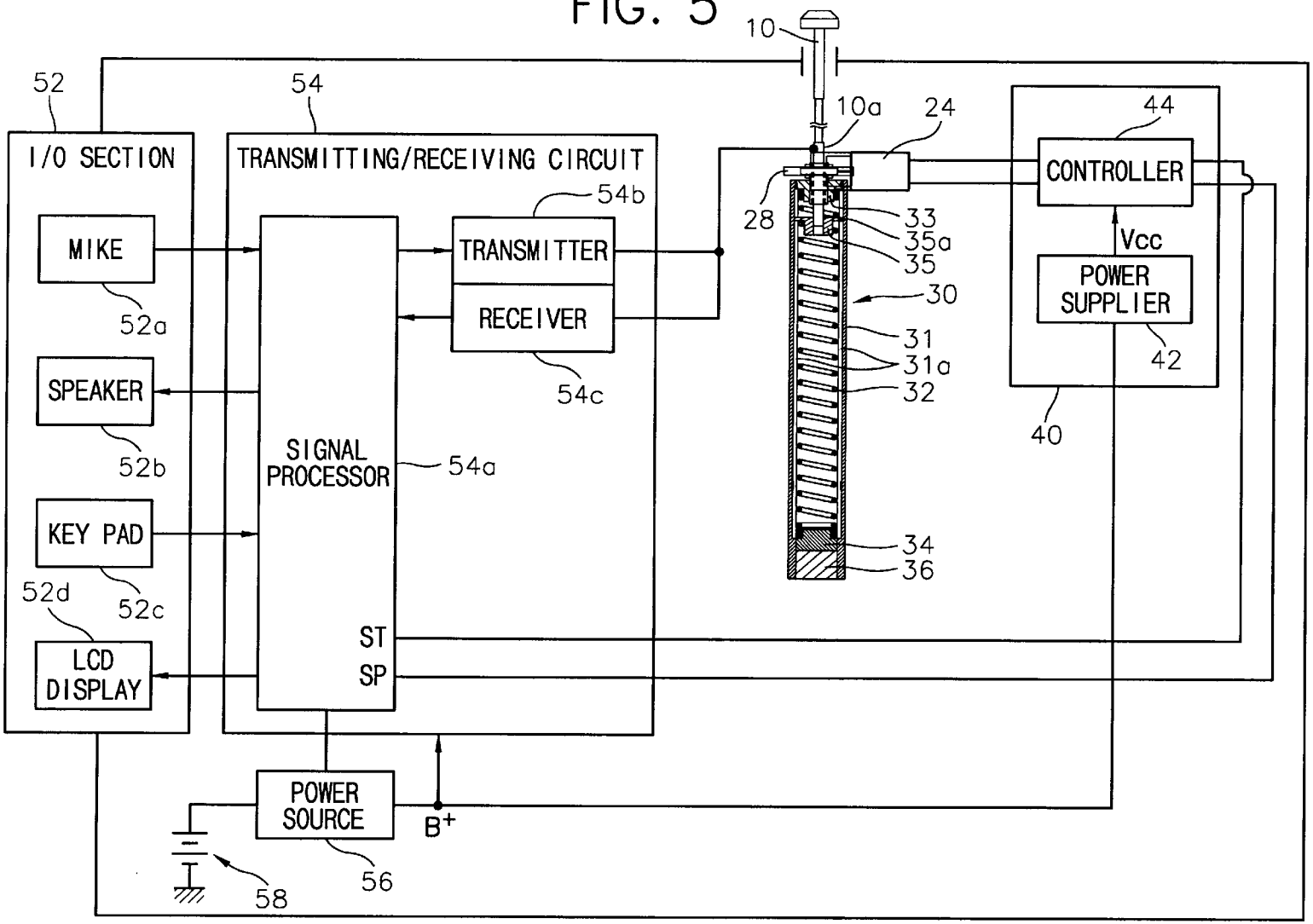
FIG. 5 is a view for showing a structure of a wireless communication apparatus according to an embodiment of the present invention.

FIG. 5 shows a circuit of the wireless communication apparatus shown in FIG. 4. As shown in FIG. 5, the cellular phone comprises an input-output section 52, transmitter/receiver circuits 54, a power supplier 56 and a motor control section 40.

Input-output section 52 comprises a microphone 52*a*, a speaker 52*b*, a keypad 52*c* and a liquid crystal display section 52*d*. Transmitter/receiver circuits 54 comprise a signal processing section 54*a*, a transmitting section 54*b* and a receiving section 54*c*. Input-output section 52 inputs a sound information through microphone 52*a* and outputs the sound information through speaker 52*b*. And, input-output section 52 inputs a function command and a telephone number by keypad 52*c* and displays the function, number and characters on liquid crystal display section 52*d* with regards to the input.

In transmitter/receiver circuits 54, the input and output signals from input-output section 52 are signal-processed at signal processing section 54*a* and are modulated to a high frequency signal by transmitting section 54*b* so as to transmit the modulated signal through antenna 10. A signal received through antenna 10 is demodulated by receiving section 54*c*, is processed by signal processing section 54*a* and is then given to input-output section 52. Also, signal processing section 54*a* of transmitter/receiver circuits 54 generates a communication-start signal and a communication-end signal.

Power section 56 receives an energy from a battery 58 so as to generate operating voltages(B+) for each circuit section.

Motor control section 40 comprises a power section 42 and a control section 44 consisting of microprocessors. The operating voltage(B+) supplied from power section 42 is adjusted to a driving voltage(Vcc) through a power circuit 42 so as to be transmitted to control section 44. Also, from transmitter/receiver circuits 54, the communication-start and communication-end signals are transmitted to control section 44. Control section 44 comprises a one-chip microprocessor and receives the communication-start and communication-end signals so as to drive motor 24 clockwise or counterclockwise during a predetermined time.

Figure 6:
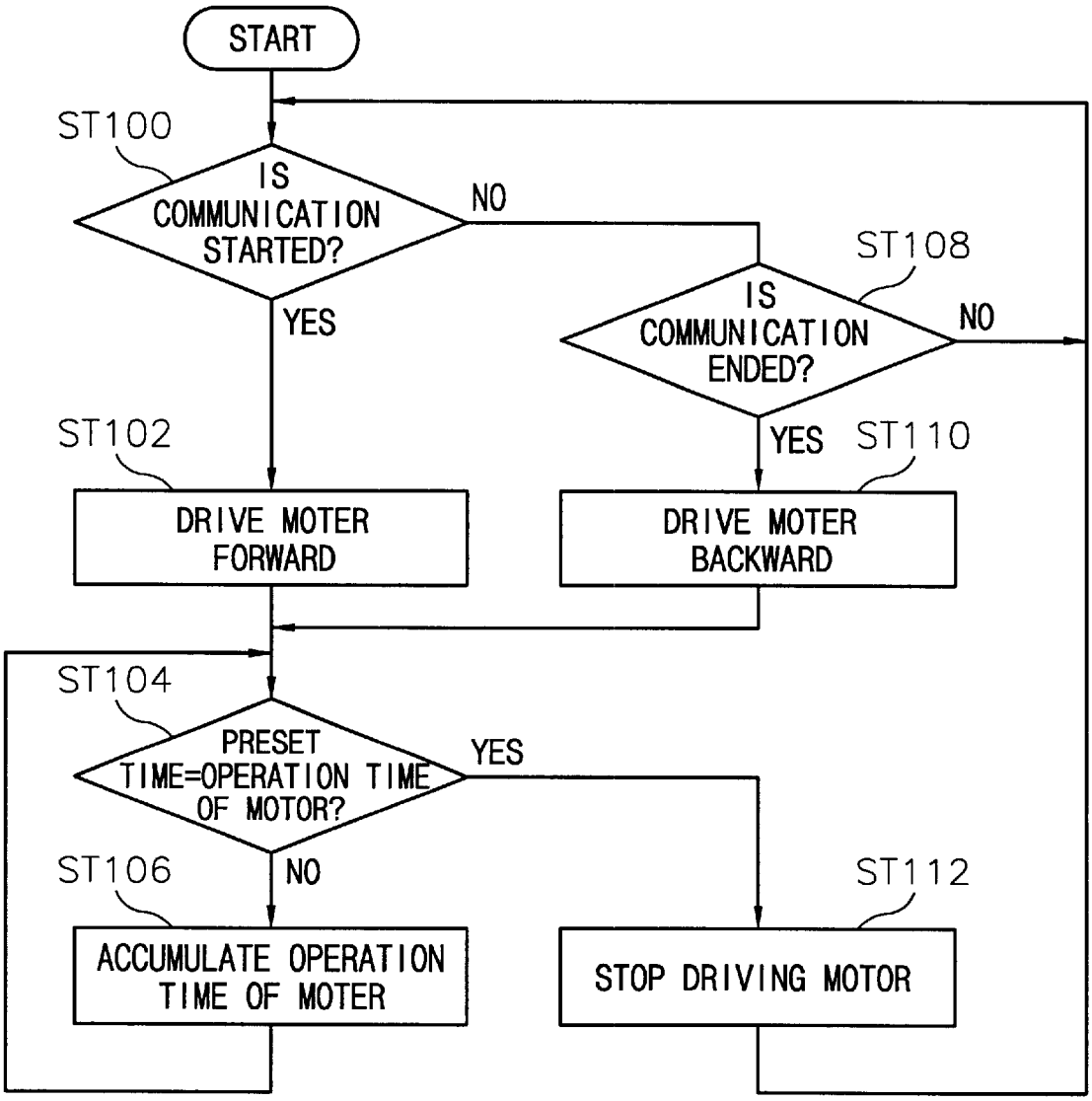
FIG. 6 is a flow chart for illustrating a control operation of a motor control section according to an embodiment of the present invention.

Hereinafter, the operation of the present invention will be described with reference to the accompanying drawings, especially FIG. 6.

Figure 7:
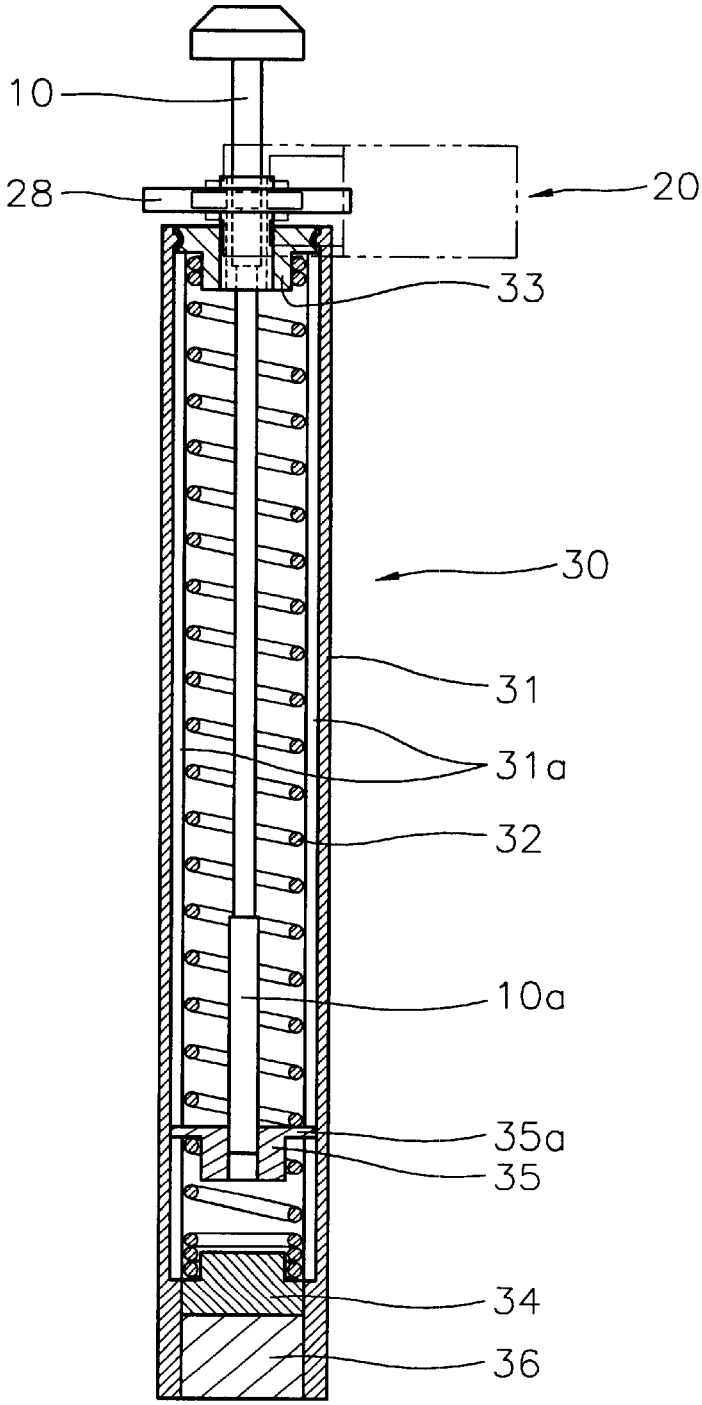
FIG. 7 is a view for showing a lead-in state of the power antenna apparatus shown in FIG. 1.

At an initial state, antenna 10 is retracted in antenna housing 31 as shown in FIG. 7. At this state, when the user opens a flip-type cover and pushes a button, the communication-start signal is transmitted to control section 44 through transmitter/receiver circuits 54 and is checked by control section 44 (step ST100). That is, when the input of the communication-start signal is detected, control section 44 drives motor 24 to be rotated in a positive direction, that is, a forward direction (step ST102).

While motor 24 is rotating in the positive direction, a rotational force is transmitted to coil spring 32 through driving gear 26, following gear 28 and upper supporting member 33 in turn so that coil spring 32 rotates counterclockwise when being viewed from a lower entrance of antenna housing 31. At this time, a spiral slant of the coil spring 32 thrusts protrusions 35*a* of carrying member 35 into a spiral direction of the coil spring 32. Since protrusions 35*a* are confined within guide slots 31*a* and thus a tangential component with respect to the rotational axis of a spiral directional force can not contribute to an effective movement of carrying member 35 into a circumferential direction and only a vertical component of the spiral directional force is effective for a movement of carrying member 35, protrusions 35*a* are forced to move upward along guide slots 31*a*. Accordingly, as carrying member 35 moves upward along guide slots 31*a*, antenna 10, whose lower end is tightly coupled with carrying member 35, moves upward so as to be extracted from antenna housing 31.

Figure 8:
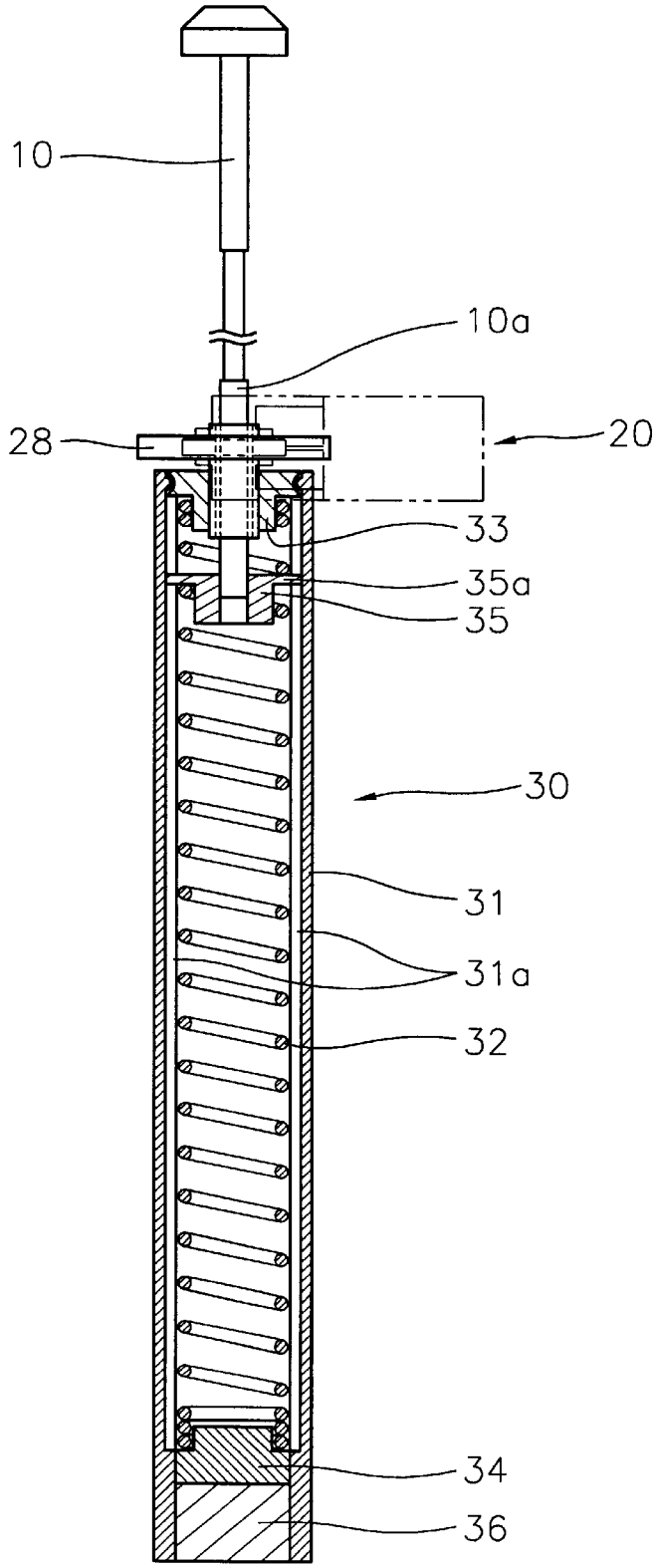
FIG. 8 is a view for showing a drawing-out state of the power antenna apparatus shown in FIG. 1.

Control section 44 compares an operation time of motor 24 in the positive direction with a predetermined time (step ST104). For this comparison, control section 44 accumulates the operation time during the operation of motor 24. When the operation time is below the predetermined time, control section 44 keeps on the accumulation of the the operation time (step ST106), and implements again step ST104. When the accumulated operation reaches the predetermined time, control section 44 stops the operation of motor 24 (step ST112) and returns to step ST100. That is, the predetermined time is the time to be taken for antenna 10 to be fully extracted from antenna housing 31 as shown in FIG. 8 from a state of being fully embedded in antenna housing 31 as shown in FIG. 7. The predetermined time can be obtained by a method of trial and error under a specified condition of the power antenna apparatus. Here, preferably motor 24 is controlled to rotate further so that coil spring 32 can be rotated further one or two turns over an expected moving distance so as to push up the metal part 10*a* of the lower end of antenna 10 to a contacting portion of a cellular phone circuitry. This improves a contacting reliability so as to avoid a sensitivity decrease and a noise generation, thereby improving the communication quality.

When the user closes the flip-type cover after the communication is finished or pushes an end button, transmitter/receiver circuits 54 generate the communication-end signal and control section 44 checks the generation of the communication-end signal (step ST108). That is, when the communication-end signal is checked at step ST108, control section 44 drives motor 24 in a negative direction, that is, a backward direction (step ST110). By the backward rotation of motor 24, a rotational force is transmitted to coil spring 32 through driving gear 26, following gear 28 and upper supporting member 33 in turn so as to rotate coil spring 32 clockwise.

At this time, the spiral slant of coil spring 32 urges protrusions 35*a* of carrying member 35 to a spiral direction. In this case, in the opposite of the case of the counterclockwise rotation of coil spring 32, since protrusions 35*a* are confined by guide slots 31*a*, only a vertical downward component of the spiral directional force is effective and protrusions 35*a* are forced to move downward along guide slots 31*a*. Accordingly, carrying member 35 moves downward along guide slots 31*a* and thus antenna 10 of which the lower end is secured to carrying member 35 moves downward so as to retract into antenna housing 31. Control section 44 also compares the operation time of the motor in the downward movement with the predetermined time (step ST104). When the operation time is below the predetermined time, control section 44 keeps on the accumulation of the operation time (step ST106) and carries out step ST104 again. When the accumulated operation time becomes equal to the predetermined time, control section 44 stops the operation of motor 24 (step ST112) and returns to step ST100. Here, the predetermined time is a time to be taken for antenna 10 to be fully retracted into antenna housing 31 as shown in FIG. 7 from a state of being fully extracted from antenna housing 31 as shown in FIG. 8. Logically, an identical time can be applied as the predetermined time in both of the extraction and retraction. Here, motor 24 is controlled to rotate further so that coil spring 32 is rotated further one or two turns over the expected moving distance so as to attach a head of antenna 10 to the cellular phone case.

Meanwhile, when an external force is applied to the antenna during the movement of the antenna, that is, when the antenna is interfered by an obstacle in an extracting path upon being extracted or the antenna is held back by a hand upon being retracted, the external force will be transferred to carrying member 35 so as to stop a movement of carrying member 35. But even in this case, motor 24 will be continuously driven to rotate coil spring 32 with overcoming the external force until the predetermined time would pass, but carrying member 35 can not advance forward. Accordingly, in both cases of the extraction and the retraction, one portion of coil spring 32 to be passed with respect to a current position of carrying member 35 is turned sparse in a coil turn to experience a tension. And, the other portion of coil spring 32 that has been already passed by carrying member 35 is turned dense in the coil turn to experience a compression. At this state, when the external force is removed, carrying member 35 moves quickly until the tension or the compression is relaxed. As a result, there is no difference in an advanced distance during a time interval with or without being interfered by the external force.

Figure 9:
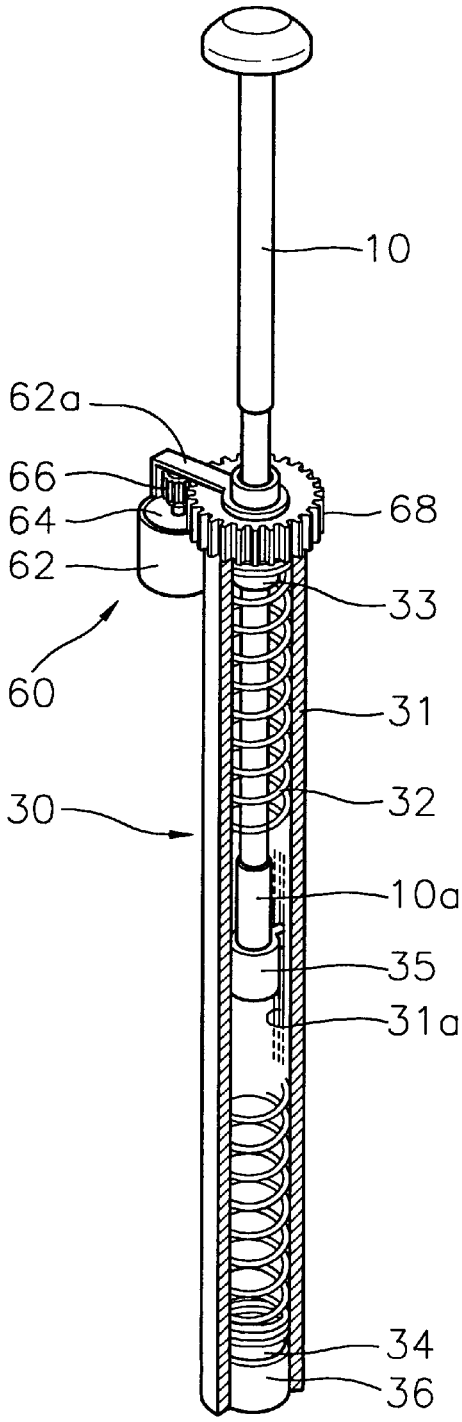
FIG. 9 is a perspective view for showing a structure of a power antenna apparatus according to another embodiment of the present invention.

FIG. 9 depicts a second embodiment according to the present invention. The same elements other than the elements explained below are given to the same numerals. As shown in FIG. 9, the second embodiment is different from the first embodiment on the grounds that there are provided spur gears as a means for transferring the rotational force of a motor 64 in a driving unit 60 and that motor 64 is aligned laterally. That is, a driving gear 66 is coupled to a driving shaft of motor 64 and a following gear 68 is assembled to an upper edge of an extension portion 62*a* of a housing 62. Driving and following gears 66 and 68 are engaged with each other.

Figure 10:
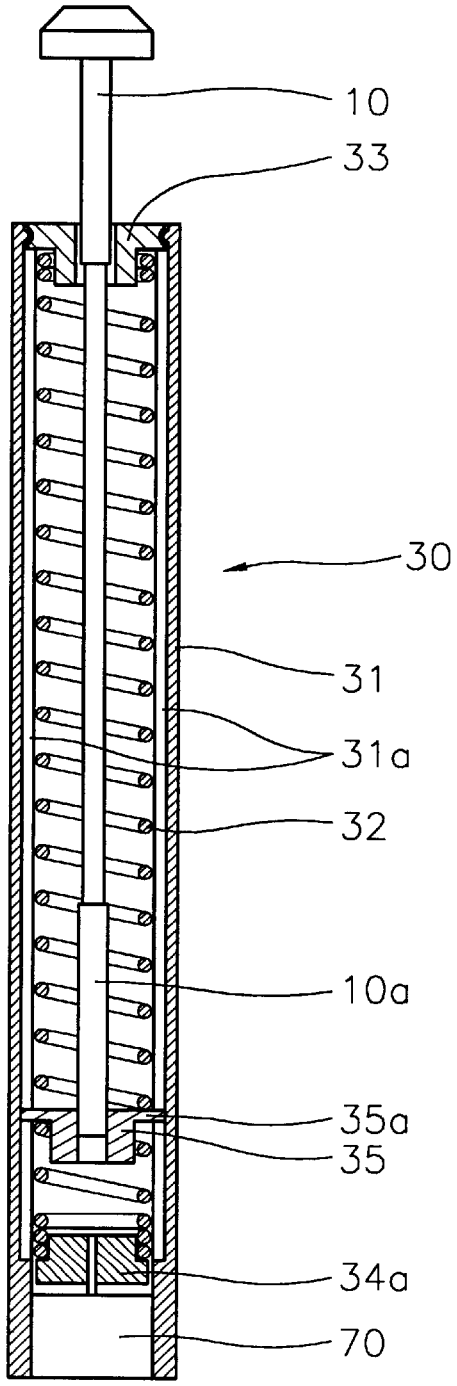
FIG. 10 is a view for showing a structure of a power antenna apparatus according to a further embodiment of the present invention.

FIG. 10 depicts a third embodiment according to the present invention. The same elements other than the elements explained below are given to the same numerals. As shown in FIG. 10, a motor 70 is installed within a lower entrance of antenna housing 31 and lower supporting member 34*a* is coupled to the driving shaft of motor 70. Coil spring 32 is press-fitted into a boss of lower supporting member 34 so that lower supporting member 34 can directly transfer the rotational force of motor 70 to coil spring 32. In this embodiment, despite not being shown in FIG. 10 precisely, a motor module including a deceleration gear assembly installed within a motor housing can be recommended as motor 70 in order to obtain a large torque.

Figure 11:
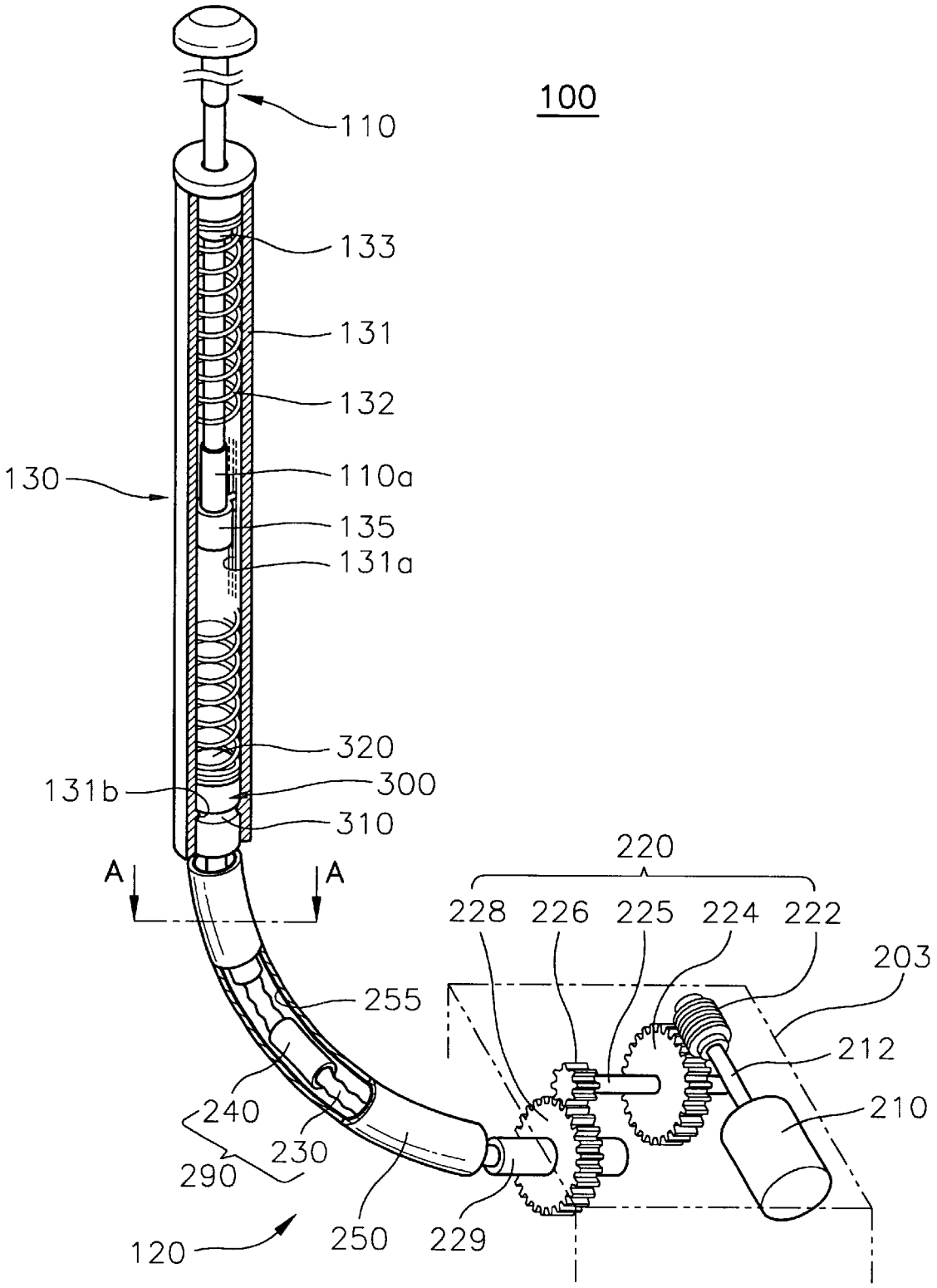
FIG. 11 is a perspective view for showing a structure of the power antenna apparatus according to the present invention.
Figure 12:
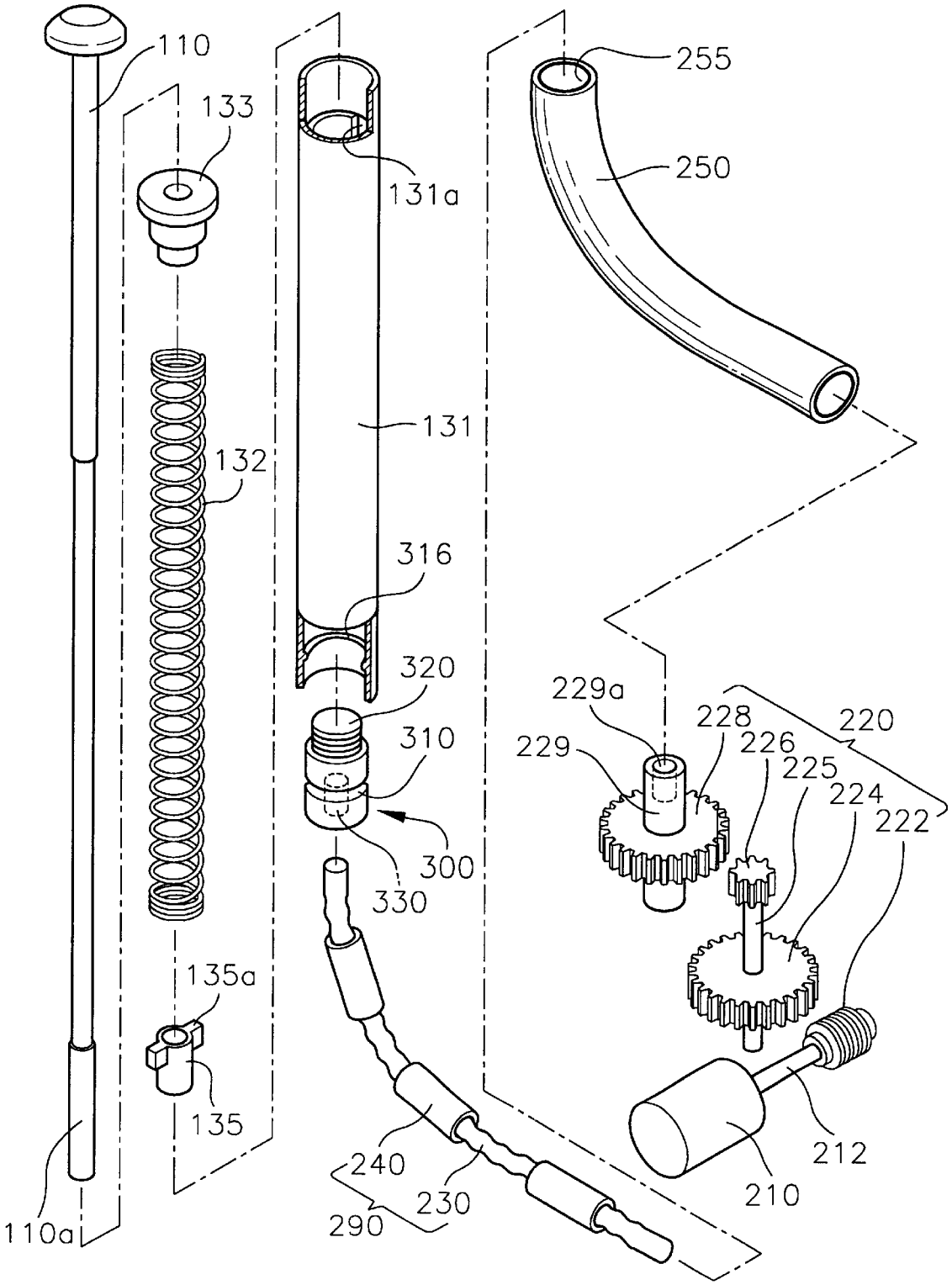
FIG. 12 is a disassembly perspective view of a power antenna apparatus according to a fourth embodiment of the present invention.

FIGS. 11 to 14 illustrate a fourth embodiment of the present invention. In FIG. 11, the power antenna apparatus includes an antenna 110, a driving unit 120 and a transport unit 130. Referring to FIG. 12, driving unit 120 comprises a motor 210, a deceleration gear assembly 220 for reducing an output speed of motor 210, and a driving force transmission means 290 being connected to an output terminal of deceleration gear assembly 220 by a portion thereof and also being connected to transport unit 130. A coreless-type direct current motor whose size is as small as a diameter of 4 to 6 mm is also recommendable as motor 210. Reduction gear assembly 220 includes a first gear 222, with a first diameter, installed to a driving shaft 212 of motor 210; a second gear 224, with a second diameter larger than the first diameter, geared with first gear 222; a third gear 226, with a third diameter smaller than the second diameter, installed on a rotation shaft 225 extended from a center of second gear 224; and a fourth gear 228, with a fourth diameter larger than the third diameter, geared with third gear 226. A cylindrical element 229 with a blind hole 229*a* of a predetermined depth is extended from a canter of fourth gear 228.

When driving shaft 212 and the rotation shaft of second gear 224 are aligned in parallel, first gear 222 and second gear 224 are geared in a spur gear way with each other. When driving shaft 212 and the rotation shaft of second gear 224 are aligned perpendicularly, first gear 222 and second gear 224 are geared in a worm-worm wheel gear way with each other.

Transport unit 130 includes a cylinder type antenna housing 131, a coil spring 132, a carrying member 135, a housing stopple 133 and a rotation member 300. Carrying member 135 is the same with carrying member 35 aforementioned .

Antenna housing 131 is formed on an inner wall with a pair of guide slots 131*a* extending laterally and receives coil spring 132. Coil spring 132 is rotatably supported and confined within antenna housing 131 by housing stopple 133 and rotation member 300. Housing stopple 133 is press-fitted into an upper top portion of antenna housing 131.

Rotation member 300 is a cylinder type member and is formed on an outer surface with a circular groove 310. Rotation member 300 has a cylindrical neck 320 which extends a predetermined length from a top surface thereof. Cylindrical neck 320 has a blind hole 330 of a predetermined diameter which extends thereinto from a base surface thereof. Antenna housing 131 is formed on a lower side of an inner surface thereof with a circular projection 131*b* so that, when being inserted into antenna housing 131, rotation member 300 is engaged with circular groove 310 with a margin to be set rotatably.

Driving force transmission means 290 includes a flexible wire 230 that both ends thereof are press-fitted into blind hole 229*a* of cylindrical member 229 and blind hole 330 of rotation member 300, respectively. Flexible wire 230 cam be made of, for example, a Fe-Ni alloy. Preferably, flexible wire 230 is recommended to have a tensile strength as strong as 100 kgf/mm$^2$, a coefficient of thermal expansion as low as $5\times10^{-6}$/, a rupture strength as strong as 16 times or more. Here, the rupture strength can be defined as a twist-time of the flexible wire being turned into a twisted state at which the flexible wire will begin to be broken down when the flexible is twisted in a speed of 60 rpm under a condition of a ratio of a diameter to a length being 100. As for another embodiment, flexible wire 230 can be made of a strong synthetic resin against the twist. Moreover, driving force transmission means 290 can further include a reinforcing member in order to minimize the twist phenomenon of flexible wire 230 by a rotation of motor 210. The reinforcing member includes multiple solid members 240 being regularly arranged along with flexible wire 230 and being tightly extrapolated to flexible wire 230. Effective reinforcement can be accomplished because the whole length of flexible wire 230 has little change and a length to be twisted in reality can be reduced owing to solid members 240. According to an installation location of motor 210, flexible wire 230 is arranged between motor 210 and rotation member 300 so as to minimize a degree of suspension curvature of flexible wire 230. A wire assembly 290, as a simple constitution of driving force transmission means 290, is covered up by a covering cable 250. Covering cable 250 is manufactured by a multiple steel wire fiber being twisted, having a cylindrical cavity, being flexible and strong against a mechanical compression or twist. Covering cable 250 is pasted on an inner surface being contacted with wire assembly 290 with a grease 255 so as to reduce a frictional force caused by a rotation of wire assembly 290. The whole length of wire assembly 290 is received by covering cable 250 so that, while motor 210 is in operation, wire assembly 290 can be prevented from being vibrated and dropped and thus wire assembly 290 can be rotated smoothly.

Meanwhile, carrying member 135 is formed on an outer surface with a pair of protrusions 135*a* extending out coil spring 132 and being inserted into a pair of guide slots 131*a* of antenna housing 131. When coil spring 132 is rotated, carrying member 135 is carried along a spiral of coil spring 132 into a lateral direction of antenna 110 to extract of retract antenna 110.

With reference to FIG. 12, an assembly order of transport unit 130 will be described below. Firstly, coil spring 132, having being received in an inner space thereof with carrying member 135, is inserted through an upper entrance into antenna housing 131, and then housing stopple 133 is press-fitted into the upper entrance of antenna housing 131. Next, rotation member 300 is pushed into a lower entrance of antenna housing 131 so as to make circular groove 310 of rotation member 300 be fitted to circular protrusion 131*b* formed in the inner surface of antenna housing 131. By doing this, a work of assembling transport unit 130 can be completed.

Figure 13A:
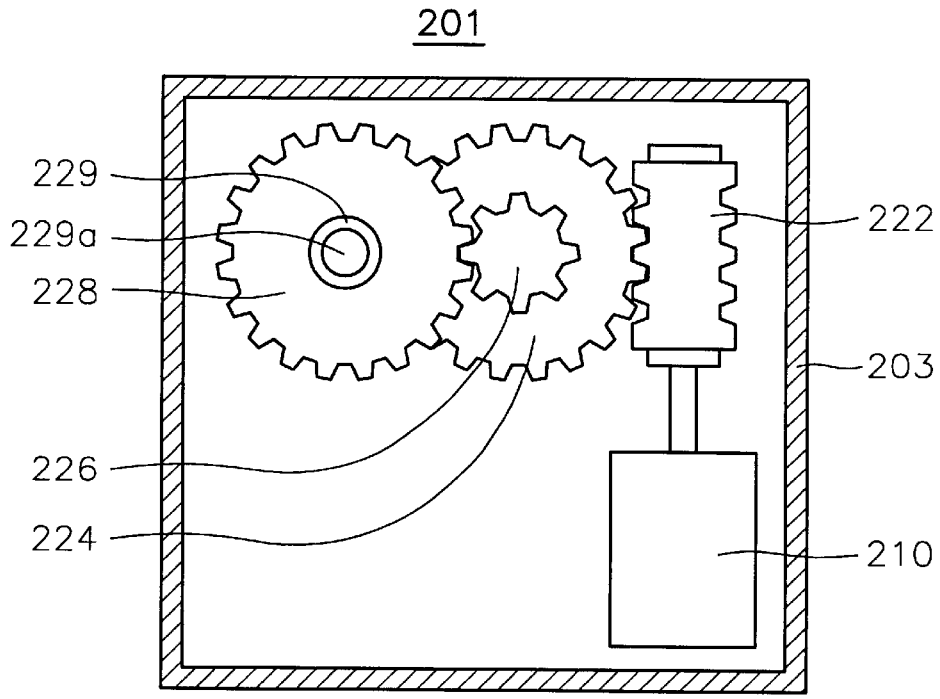
FIGS. 13A and 13B are a front view and a side view of a motor unit of the power antenna apparatus shown in FIG. 11.
Figure 13B:
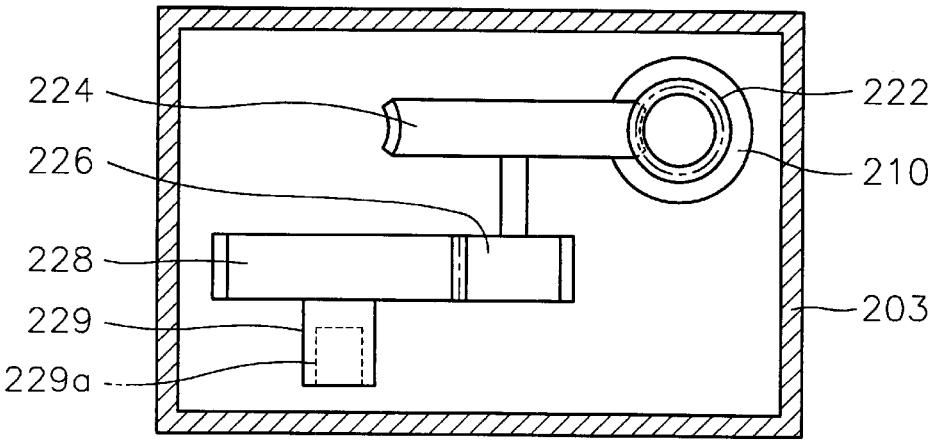

Both motor 210 and deceleration gear assembly 220 can be assembled into a single motor unit 201. FIGS. 13A and 13B are a front view and a side view of motor unit 201, respectively. Respective gears are rotatably supported by an inner wall of a motor unit case 203.

Next, after a decision on where motor unit 201 is to be installed, wire assembly 290 with solid member 240, coupled with solid member 240 and then covered by covering cable 250, is press-fitted into blind hole 330 of rotation member 300 by one edge and to blind hole 229*a* of cylindrical member 229 protruded out from motor unit 201 by the other edge.

Figure 14:
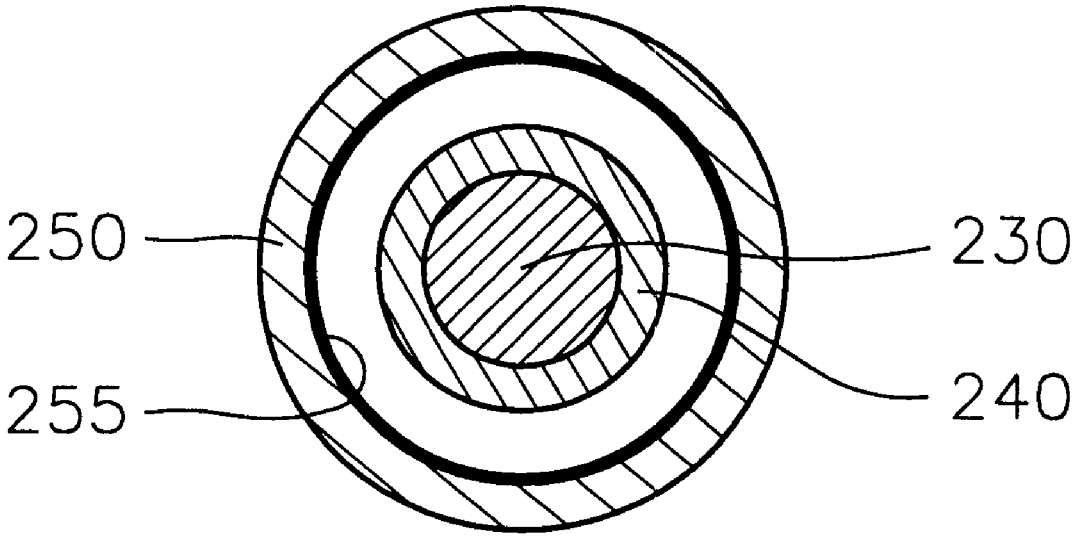
FIG. 14 is a sectional view of a wire assembly cut along line A—A.

As shown in FIG. 14, wire assembly 290 is fully covered by covering cable 250 according to an installation location and a slant angle. When motor 210 is in operation, wire assembly 290 is rotated with experiencing a slight frictional force owing to grease layer 255 pasted on the contact between the inner surface of covering cable 250 and wire assembly 290. Covering cable 250 receives a full length of wire assembly 290 therein, and thus a vibration and a drop of wire assembly 290 can be prevented.

If power antenna apparatus 100 of the fourth embodiment is applied to a wireless telephone as a cellular phone or the like, driving unit 120 is cased in an antenna housing of the wireless telephone together with other devices of the wireless telephone, and transport unit 130 and antenna 110 are simply assembled into the antenna housing after completion of the casing work. The structure as such makes possible the adaptive installation of power antenna apparatus 100 within a space of a conventional telephone As described above, an external force applied to the antenna is absorbed by the coil spring so as to prevent the external force from being transmitted to the driving device, thereby improving the reliability thereof and simplifying a control scheme of a driving motor into an ON/OFF control method making control circuit design work easy.

Also, the coil spring transmits the rotational force so as to simplify the construction thereof, thereby reducing the cost thereof and easily assembling the power antenna apparatus.

Moreover, an employed coil spring, as having a predetermined number of turns, control work to extract/retract the antenna can be performed by operating the driving motor to be rotated over predetermined times with little loss of energy.

Furthermore, the power antenna apparatus can be adapted to a conventional cellular phone by changing the conventional design slightly.

Furthermore, while the antenna is extracting, using a coil spring enables a compression to be applied in an extracting direction so as to make the metal part of the antenna contact with the cellular phone circuitry. Also, while the antenna is retracting, using the coil spring enables a compression to applied in a retracting direction so as to make the head of the antenna contact with the case.

Especially, according to the fourth embodiment, since the power antenna apparatus is structured so that the motor can transmit its driving force to the antenna with little dependency on the installation location of the motor, the motor is more free from the installation location, thereby extending an applicability of the power antenna apparatus.

Furthermore, according to the above-described structure of the power antenna apparatus, even when the antenna housing and the coil spring are bent slightly, the antenna transmission is not interfered therewith so that the power antenna apparatus can be installed even in a space which is not straight.

Furthermore, so far, the present invention is described with a structure in which the coil antenna and the antenna are separated from each other, but the present invention is more available at a structure in which both antennas are integrally formed. In the integrated antenna structure, the coil antenna is assembled to the head of the antenna when the antenna is extracted, so a vibration caused by the self-weight of the integrated antenna structure is not negligible. But the vibration can be absorbed in the coil spring according to the present invention.

While the present invention has been particularly shown and described with reference to a particular embodiment thereof, it will be understood by those skilled in the art that various changes and modifications can be made within the scope of the invention as hereinafter claimed.

What is claimed is:

1. A power antenna apparatus for extracting/retracting an antenna from/into an antenna housing, comprising:

a coil spring disposed within the antenna housing;

driving means for rotating the coil spring;

an antenna carrying member, fixedly coupled with a lower portion of the antenna, loaded on a spiral of the coil spring; and means for guiding the antenna carrying member, which is spirally moved by the coil spring rotated by the driving means, to move vertically along the antenna housing.

2. The power antenna apparatus as claimed in claim 1, wherein the guiding means is at least one vertical guide slot formed on an inner wall of the antenna housing and at least one end of the antenna carrying member is confined within the vertical guide slot.

3. A power antenna apparatus for extracting/retracting an antenna from/into an antenna housing, comprising:

a driving assembly for generating a rotational force;

an antenna housing having a guide slot extending longitudinally on an inner surface of the antenna housing;

a rotary member installed at one end of the antenna housing and rotated by the rotational force;

a coil spring rotatably accommodated in the antenna housing, one end of the coil spring being fixed to the rotary member, and an antenna carrying member received together with the antenna within the coil spring, said member being fixedly coupled to a lower end of the antenna and having protrusions which are disposed within the guide slot of the antenna housing for carrying the antenna along with the guide slot to extract or retract the antenna by rotation of the coil spring.

4. A power antenna apparatus for extracting/retracting an antenna of a wireless communication device by a rotational force of a motor, the power antenna apparatus comprising:

a motor controller for controlling operation of the motor by providing driving power in response to a communication-start signal and a communication-end signal of a wireless communication device;

an antenna housing having a guide slot extending longitudinally on an inner surface of the antenna housing;

a following gear installed at an end portion of the antenna housing and having a shaft hole through which the antenna passes;

a driving gear coupled to a rotary shaft of the motor and engaged with the following gear;

a coil spring rotatably disposed within the antenna housing, one end of the coil spring being fixed to the following gear, and an antenna carrying member received together with the antenna within the coil spring and fixedly coupled with the antenna by a lower end thereof said carrying member having protrusions which are loosely inserted into the guide slot of the antenna housing, wherein the antenna is extracted from or retracted into the antenna housing by an upward component or a downward component of a frictional force between the protrusions and a spiral of the coil spring.

5. A power antenna apparatus for automatically extracting/retracting an antenna of a wireless communication device, comprising:

a motor for generating a rotational force;

a motor controller for controlling operation of the motor by providing driving power in response to a communication-start signal and a communication-end signal of a wireless communication device;

an antenna housing having a guide slot extending longitudinally on an inner surface of the antenna housing;

a rotary member installed at one end of the antenna housing and rotated by the motor;

a coil spring rotatably accommodated in the antenna housing, one end of the coil spring being connected to the rotary member, and an antenna conveying member received together with the antenna within the coil spring and fixedly coupled with the antenna by a lower end thereof, said conveying member having protrusions which are loosely inserted into the guide slot of the antenna housing for conveying the antenna along with the guide slot to extract or retract the antenna by rotation of the coil spring.

6. The power antenna apparatus as claimed in claim 5, further comprising a transfer mechanism for transferring the rotational force of the motor of the rotary member.

7. The power antenna apparatus as claimed in claim 6, wherein the motor controller controls the motor in a first direction in response to the communication-start signal so that the antenna can be fully extracted from the antenna housing, and in a second direction opposite to the first direction in response to the communication-end signal so that the antenna can be fully retracted into the antenna housing.

8. A wireless communication apparatus having an antenna extractable from or retractable into an antenna housing of the wireless communication apparatus, comprising:

means for inputting/outputting information;

transmitting/receiving circuit means for processing and modulating an input signal from the inputting/outputting means and transmitting a modulated radio signal through the antenna, and for demodulating and processing a radio signal received through the antenna and providing a processed signal to the inputting/outputting means;

a coil spring disposed within the antenna housing;

driving means, in response to communication start/stop operations of the transmitting/receiving circuit means, for rotating the coil spring;

an antenna carrying member, fixedly coupled with a lower portion of the antenna, loaded on a spiral of the coil spring; and means for guiding the antenna carrying member, which is spirally moved by the coil spring rotated by the driving means, to move vertically along the antenna housing.

9. The wireless communication apparatus as claimed in claim 8, wherein the driving assembly includes a housing installed in the case; a motor installed in the housing; a motor control section for controlling operation of the motor by providing a driving power in response to a communication start-signal and a communication-end signal of the transmitting/receiving circuit; a following gear installed in the housing and having a shaft hole through with the antenna passes, and a driving gear coupled to a rotary shaft of the motor and engaged with the following gear.

10. A wireless communication apparatus as claimed in claim 8, wherein the guiding means is at least one vertical guide slot formed on an inner wall of the antenna housing and at least one end of the antenna carrying member is confined within the vertical guide slot.

11. A power antenna apparatus for automatically extracting/retracting an antenna in a longitudinal direction of the antenna, comprising:

a motor having a driving shaft for generating a rotational force;

a deceleration gear assembly operably connected to the driving shaft of the motor;

an antenna housing having a guide slot extending longitudinally on an inner surface of the housing;

a rotary member rotatably disposed within the antenna housing and rotated by a transferred rotational force generated by the motor;

a force transferring assembly being operably connected to the deceleration gear assembly and the rotary member for transferring the rotational force of the motor to the rotary member;

a coil spring rotatably disposed within the antenna housing, one end of the coil spring being fixed to the rotary member such that the rotary member and spring rotate together, and an antenna carrying member received together with the antenna within the coil spring and being connected to a lower end of the antenna said carrying member, having protrusions which are disposed within the guide slot of the antenna housing for carrying the antenna along with the guide slot to extract or retract the antenna.

12. The power antenna apparatus as claimed in claim 11, wherein the power antenna apparatus further includes a motor controller for controlling operation of the motor by providing the motor with driving power responsive to the control signal.

13. The power antenna apparatus as claimed in claim 11, wherein the force transferring assembly includes a flexible and anti-twist wire fixedly coupled both to the rotary member and the deceleration gear assembly for allowing flexible alignment between an output shaft of the deceleration gear assembly and a rotary axis of the rotary member.

14. The power antenna apparatus as claimed in claim 13, wherein the force transferring assembly further includes a reinforcing member for preventing the wire from being twisted due to the rotational force.

* * * * *